US008369740B2

(12) United States Patent
Gonzales Perez et al.

(10) Patent No.: US 8,369,740 B2
(45) Date of Patent: Feb. 5, 2013

(54) REMANUFACTURED TONER CARTRIDGE WITH ADDED CLEANING ROLLER FOR THE PRIMARY CHARGE ROLLER, AND METHODS

(75) Inventors: Jesus Gonzales Perez, Chatsworth, CA (US); Sagie Shanun, Valley Village, CA (US); Scott Harland, Valencia, CA (US)

(73) Assignee: Wazana Brothers International, Inc, Van Nuys, CA (US)

( * ) Notice: Subject to any disclaimer, the term of this patent is extended or adjusted under 35 U.S.C. 154(b) by 490 days.

(21) Appl. No.: 12/753,748

(22) Filed: Apr. 2, 2010

(65) Prior Publication Data

US 2011/0243600 A1 Oct. 6, 2011

(51) Int. Cl.
*G03G 15/00* (2006.01)
*G03G 15/02* (2006.01)

(52) U.S. Cl. ..... 399/109; 399/100; 399/174; 399/176

(58) Field of Classification Search ..... 399/109, 399/100, 174, 176
See application file for complete search history.

(56) References Cited

U.S. PATENT DOCUMENTS

| | | | | |
|---|---|---|---|---|
| 5,572,293 | A | 11/1996 | Kikuchi et al. | |
| 6,621,996 | B1 * | 9/2003 | Meyer et al. | 399/109 |
| 6,775,508 | B2 | 8/2004 | Macht et al. | |
| 7,313,352 | B2 * | 12/2007 | Shinohara et al. | 399/301 |
| 7,460,810 | B2 | 12/2008 | Sampe et al. | |
| 7,477,862 | B2 | 1/2009 | Takaya et al. | |
| 7,574,157 | B2 | 8/2009 | Ishikawa | |
| 2004/0042822 | A1 * | 3/2004 | Fujishiro et al. | 399/159 |
| 2009/0087213 | A1 | 4/2009 | Takaya et al. | |

* cited by examiner

*Primary Examiner* — Walter L Lindsay, Jr.
*Assistant Examiner* — David Bolduc

(57) ABSTRACT

A remanufactured laser printer toner cartridge, and methods, having an added primary charge roller cleaning roller assembly. In an exemplary embodiment, the cleaning roller assembly engages the bare ends the primary charge roller shafts; installation of the cleaning roller assembly into the cartridge is accomplished by reinstalling the primary charge roller, with the assembly, into the cartridge's primary charge roller shaft saddles. The cleaning roller may be adapted to rotate through contact with the primary charge roller.

15 Claims, 5 Drawing Sheets

REMANUFACTURED TONER CARTRIDGE WITH ADDED CLEANING ROLLER FOR THE PRIMARY CHARGE ROLLER, AND METHODS

TECHNICAL FIELD

The invention relates generally to remanufactured toner cartridges, and particularly to systems, methods, and apparatus for cleaning the Primary Charge Roller in a remanufactured laser printer toner cartridge.

BACKGROUND

Toner cartridges for laser printers are well known in the art. Generally, a cartridge will include sufficient toner for a large number of "typical" prints, such as 10,000 or 25,000, packaged in a housing which also contains those printing components that require periodic replacement, such as a photosensitive drum, magnetic and charging rollers, a "doctor" blade and a cleaning blade. The printing components and housing typically have a usable life, if properly cleaned and maintained, that greatly exceeds the number of prints for which toner is provided. Hence, toner cartridges are often remanufactured with a new supply of toner.

Remanufactured toner cartridges are both cost effective for consumers and environmentally sound. Original Equipment Manufacturers (OEMs) of printing equipment often provide "recycling" programs that allow consumers to return empty toner cartridges; the returned cartridges are shredded to recover some of the raw materials. Remanufacturing, in contrast, directly reuses most of the components of the cartridges, thereby greatly reducing the amount of material ending up in landfills, and having a substantially smaller "carbon footprint" than "recycling".

In a typical laser printer, a revolving photosensitive drum or belt having a surface capable of holding a localized static charge is "charged" to a uniform voltage; a modulated laser is then scanned across the surface to remove the charge from those areas which are intended to be blank in the final image. A layer of toner, in the form of a fine powder, is then applied to the belt or drum by a "doctor blade"; the toner adheres to those areas of the belt or drum that have retained a charge. The drum or belt then deposits the toner on a print medium (such as paper), and residual toner is wiped off the drum or belt by a "cleaning blade."

In early generations of laser printers, the initial charge on the belt or drum was provided by corona wires. Newer printers typically use a roller mechanism, usually called the Primary Charge Roller (PCR) to charge the drum. The shift from corona wires to PCRs helped alleviate several problems associated with early laser printers, including high ozone emissions and "corona" streaks on prints attributed to the wires.

The PCR is generally a small diameter roller made of a compliant material, and having an outer surface adapted to transfer an electrostatic charge to the photosensitive drum. The PCR is generally held against the drum or belt, with the movement of the drum or belt causing to PCR to rotate. Typically, the primary charge roller is charged with both an alternating current signal, which functions to remove any residual or "ghost" static charges on the drum left from previous images, and a direct current bias, which functions to charge the surface of the drum or belt to a uniform voltage. The amplitude of the uniform direct current bias voltage to a large extent determines the darkness of the final prints.

The PCR typically has a conductive metal shaft, with each end of the shaft resting in a "saddle" which is configured to hold the PCR against the photosensitive drum, typically using springs. At least one of the saddles is formed of a conductive material, through which electrical contact with the PCR is provided. In some cartridges, a bare section of shaft exists at each end of the PCR adjacent to the saddle, as will be evident in the discussion below. Although replacement parts are generally readily available in the cartridge remanufacturing industry, it is common practice for cartridge remanufacturers to clean and reuse the cartridge's original PCR roller.

A challenge faced by toner cartridge remanufacturers is variability among components available for use in remanufactured cartridges. Components may be of varying ages, minor engineering changes may have been made between production runs of a cartridge, or it may be necessary to use a combination of refurbished parts and new replacement parts.

The toner used in a remanufactured cartridge can also vary from that used by the OEM. While the remanufacturer will typically specify a toner that essentially matches the important performance characteristics of the OEM toner, and therefore provides a print quality close to the OEM toner, toner formulations are complex, involving many production steps and constituents. Some aspects of the OEM toner may be covered by patents, or different toner additives may be used due to availability or cost.

The OEM has the ability to "fine tune" the printing system, including the components in the cartridge, the toner, and the operation of the printer itself, including various initialization and cleaning operations. The OEM may, for example, formulate the materials of the photosensitive drum, the cleaning blade, and PCR such that the printing system functions reliably for the number of prints provided by the original supply of toner, but not necessarily for the extended life of a refilled cartridge. The OEM may also utilize coatings or treatments on the components which are substantially degraded due to wear by the end of the original "life" of the cartridge.

The wear on components and differences in toner formulations may result in prints produced over time with a remanufactured cartridge exhibiting print defects. For example, prints may begin to show a gray background haze. Investigations have shown one cause of the haze to be a polymeric residue that forms on the PCR, apparently from toner additives, such as wax and cleaning agents.

Repeating defects may also appear which occur on the printed page at a frequency corresponding to the circumference of the PCR. These defects can be caused by small residual amounts of toner that are not removed from the photosensitive drum by the cleaning blade, and which are subsequently deposited on the PCR. Small spots of toner thus form on the PCR roller, which are compressed each time the spot contacts the photosensitive drum, rendering the spots essentially permanent. Since the portion of the drum contacted by the spot will not be properly charged, the resulting prints will show a recurring dark spot running down the page.

Some OEM laser printer cartridges include PCR cleaning mechanisms, although in cartridges intended for a single use this may consist only of a simple strip of film which contacts the PCR roller. Experience with remanufactured cartridges show that a basic PCR cleaner of this nature is relatively ineffective in preventing the kind of print defects often observed with remanufactured cartridges. Also known in the art are more complex PCR cleaning mechanisms, such as felt rollers, as shown, for example, in Japanese Laid-Open Patent Publication No. JP2272589 ("Image Forming Device", inventors Tanaka Hisami and Hirayama Noriko, applicant Canon KK, published 1990-11-07).

To keep the cost of remanufactured cartridges low, it is important that any modifications to the cartridge be done in a manner that requires as few steps as possible and that don't require significant changes to the cartridge itself.

There is thus a need for remanufactured toner cartridges which do not exhibit print defects attributable to PCR roller contamination, and for methods allowing simple retrofitting of cartridges.

SUMMARY

The methods and apparatus described below overcome drawbacks of known remanufactured printer cartridges by providing alternate methods and apparatus for directly removing the contaminants from the PCR, and thus to avoid or minimize printing defects associated with PCR contamination.

Embodiments include a PCR cleaning roller assembly which engages the free ends the PCR shafts. Installation of the cleaning roller assembly into the cartridge is accomplished by reinstalling the PCR, with the assembly, into the cartridge's PCR shaft saddles, with the cleaning roller adapted to rotate through contact with the PCR.

These and other embodiments, features, aspects, and advantages of the invention will become better understood with regard to the following description, appended claims and accompanying drawings.

BRIEF DESCRIPTION OF THE DRAWINGS

The foregoing aspects and the attendant advantages of the present invention will become more readily appreciated by reference to the following detailed description, when taken in conjunction with the accompanying drawings, wherein.

Reference symbols or names are used in the Figures to indicate certain components, aspects or features shown therein. Reference symbols common to more than one Figure indicate like components, aspects or features shown therein, although the components, aspects or features are not necessarily identical.

DETAILED DESCRIPTION

With reference to FIGS. 1-6 several embodiments of methods and apparatus useful in cleaning the PCR of laser printer toner cartridges will be described.

The remanufacturing of laser printer toner cartridges typically entails disassembling spent cartridges, cleaning or replacing components as necessary, reassembling the cartridge, and filling the cartridge with toner. Embodiments of the invention involve modifying the cartridge by the addition of a cleaning mechanism for the Primary Charge Roller (PCR).

Figure 1:
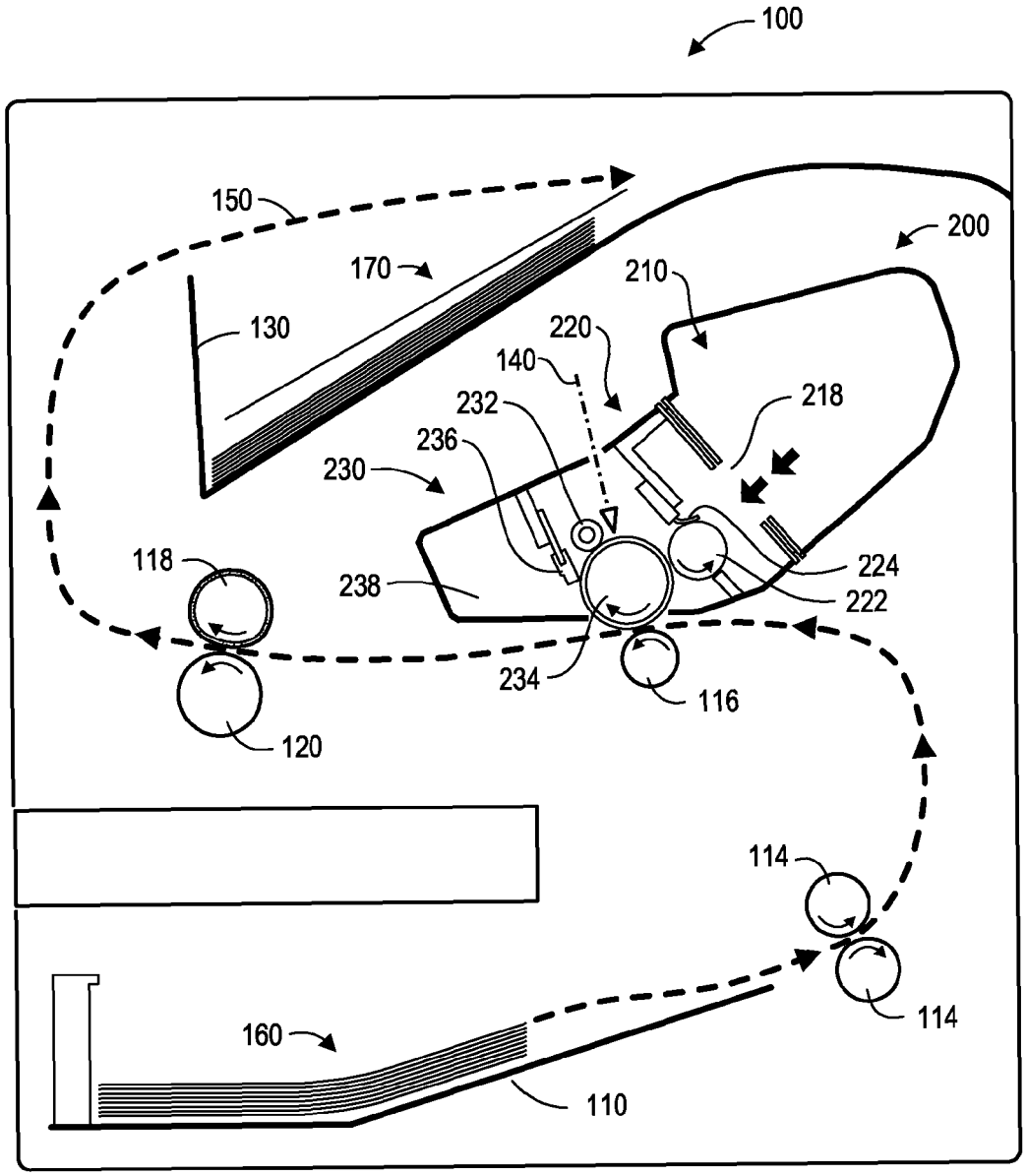
FIG. 1 is a schematic diagram illustrating in cross section an exemplary laser printer and toner cartridge.

FIG. 1 schematically illustrates in cross section an exemplary laser printer and toner cartridge. The printer 100 includes an input hopper 110 for blank print media 160 such as paper; media handling mechanisms 114 for transporting print media through the printer; exemplary print cartridge 200; transfer roller 116; fixing sleeve 118 and pressure roller 120 for fusing toner to the media; and an output media tray 130 for receiving printed media 170. The media path through the printer is denoted by the heavy dashed line 150. FIG. 1 is a simplified representation, and a typical laser printer will include multiple media paths that route print media past the print cartridge. Not shown in FIG. 1 are the printing electronics and the writing laser.

Exemplary toner cartridge 200 is made up of multiple modules, which are typically separated during the remanufacture of the cartridge. The modules may, for example, include a toner hopper assembly 210, a magnetic or developer roller section chassis 220, and a waste hopper assembly 230. Some cartridge types may consist of fewer modules; for example, the functions of the toner hopper and magnetic roller section may be combined into a single module. Various methods are typically used to join the modules, including mechanical fasteners and ultrasonic welding. In some exemplary toner cartridges the modules are also connected by cartridge end plates (not illustrated in FIG. 1) which add strength and to the cartridge and protect mechanical components, such as gear trains.

The toner hopper module 210 provides storage for a supply of fresh toner for the printer, which passes through an opening 218 in the hopper to the developing roller section chassis 220 for utilization by the printer. During printing, the developing roller 222 and "doctor" blade 224 mounted in the magnetic or developer roller section chassis serve to meter toner received from the toner hopper onto the photosensitive drum 234 of the cartridge. Toner adheres to the rotating developing roller 222; the level of toner deposited on the photosensitive drum is primarily controlled by a doctor blade 224.

The waste hopper assembly 230 of the exemplary toner cartridge includes a Primary Charge Roller (PCR) 232, the photosensitive drum 234, a wiper blade assembly 236, and a waste toner hopper compartment 238. In an exemplary toner cartridge, the waste hopper assembly may be retained to the other modules by the cartridge end plates, as discussed above. In operation, the photosensitive drum 234 receives an overall charge from the primary charge roller 232; portions of the drum are then selectively discharged by modulated light from a laser (denoted by the short-and-long dashed line 140), with the pattern of charged and discharged areas corresponding to the image to be printed. The photosensitive drum then rotates past the developing roller 222, and toner is selectively transferred to the drum based on the levels of localized charge on the drum. The photosensitive drum then rotates past the media path as print media is moved along the path; an electric charge on transfer roller 116, positioned on the opposite side of the print media, causes the toner on the drum to be attracted to print media.

A residue of toner may remain on the photosensitive drum 234 after the bulk of the toner is transferred to the print media; this residue is ideally removed from the drum by the wiper blade assembly 236 and is deposited in the waste toner hopper compartment 238.

A typical toner cartridge includes additional components not discussed above, such as mechanisms for stirring the toner and for sensing toner levels; the above discussion is intended only to serve as an overview.

After toner is deposited on the print media, the print media is carried along the printer media path to a fuser where the toner is "fused" to the media by a heated fixing sleeve 118 and pressure roller 120. The printed media 170 is then deposited in output media tray 130.

An exemplary toner cartridge may be engineered to print a specified number of "typical" pages, such as 10,000 or 25,000 pages, after which the supply of toner is exhausted. When a cartridge is depleted of usable toner, it may be remanufactured to restore it substantially to original specifications. Remanufacturing the exemplary toner cartridge generally involves disassembly of the cartridge, cleaning, refurbishing, or replacing some or all of the individual components, reassembly of the cartridge, and refilling with toner.

Disassembly of the exemplary toner cartridge may begin with the separation of the waste hopper assembly 230 and related components from the remainder of the cartridge. This may involve the removal of cartridge end plates, as discussed above. The components within the waste hopper assembly, including the PCR 232, the photosensitive drum 234, and the wiper blade assembly 236, may then be removed for cleaning, refurbishing, or replacement.

Embodiments of the invention include modifying a laser printer cartridge to add a roller cleaner mechanism to clean the Primary Charge Roller (PCR). In embodiments of the invention the PCR roller cleaner is affixed to the PCR with links which engage bare portions of the PCR shaft, allowing for simple and expeditious retrofit of the laser cartridge.

Figure 2:
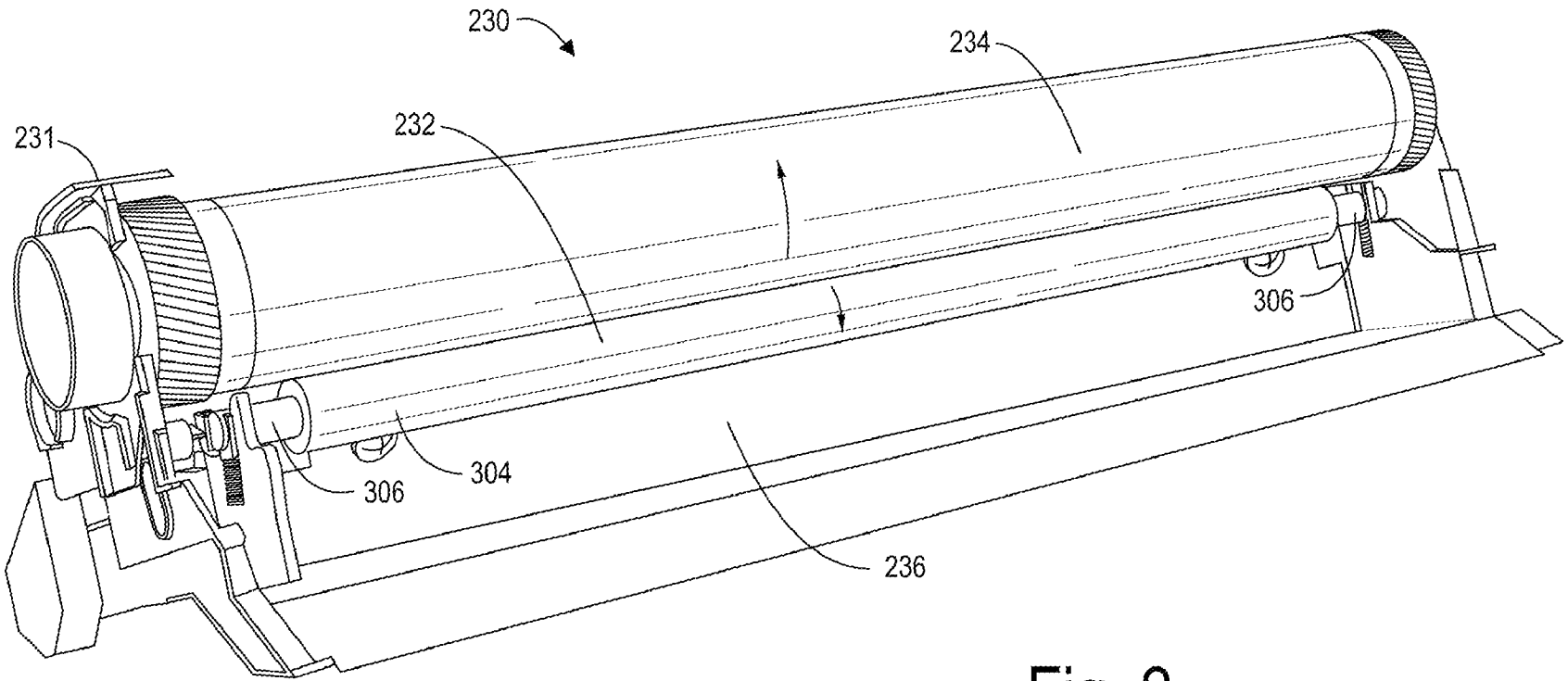
Fig. 2 PRIOR ART
FIG. 2 is a perspective view of internal components of a conventional laser printer toner cartridge, showing the photosensitive drum, cleaning blade, and PCR roller.

Referring to FIG. 2, a prior art laser printer toner cartridge waste hopper assembly 230 includes a primary charge roller (PCR) 232, a photosensitive drum 234, and a wiper blade assembly 236 (the wiper blade itself is not visible in FIG. 2), all of which are conventional and the operation of which is known. The components are enclosed in a waste hopper chassis 231.

The PCR 232 is itself made up of a central metal shaft, the shaft ends 306 of which are visible in FIG. 2, and a body portion 304 that contacts the photosensitive drum 234. The waste hopper chassis 231 includes saddles (which are better seen in FIG. 5) which retain the PCR shaft ends. It may be observed that in the exemplary toner cartridge the body 304 of the primary charge roller 232 does not extend the full length of the photosensitive drum 234, but that a bare portion of the shaft 306 of the PCR is present at each end of the PCR. These bare portions of the PCR shaft are utilized by embodiments of the invention to attach the roller cleaner, as described below.

Figure 3:
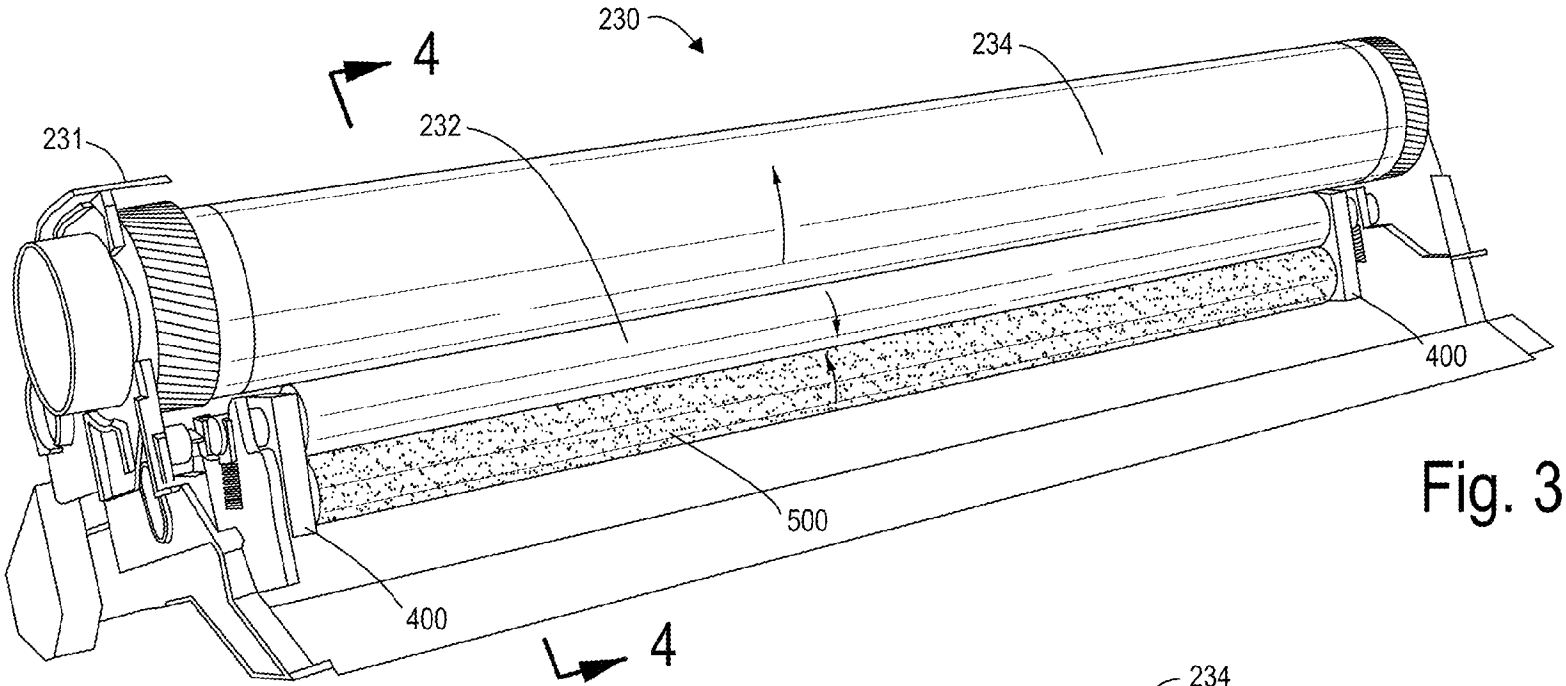
FIG. 3 is a perspective view of internal components of an exemplary laser printer toner cartridge incorporating an embodiment of the invention.
Figure 4:
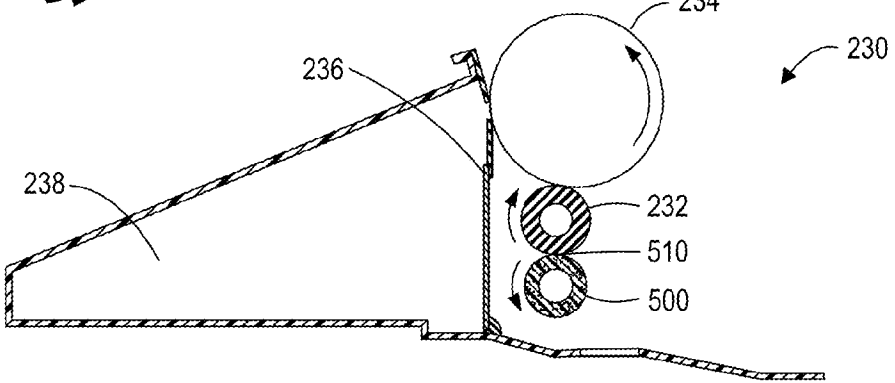
FIG. 4 is a cross-sectional view of the FIG. 3 cartridge, taken along line 4—4 of FIG. 3.

FIGS. 3 and 4 illustrate an exemplary embodiment of the invention, with FIG. 3 being a perspective view of internal components of a laser printer toner cartridge waste hopper incorporating an embodiment of the invention, and FIG. 4 being a cross-sectional view of the FIG. 3 cartridge taken along line 4—4. Again, the waste toner hopper assembly 230 includes a photosensitive drum 234 and a PCR 232 held in a waste toner hopper chassis 231. An embodiment of the PCR roller cleaner includes roller 500 held against the PCR 232 by joining links 400. The roller 500 is adapted to rotate in response to rotation of the PCR, thus cleaning the PCR of contaminants. To prevent a buildup of contaminants at the ends of the PCR 232, the roller cleaner 500 in embodiments of the invention is at least equal in width to the PCR, and may be slightly wider.

As shown in the FIG. 4 cross-sectional view, the photosensitive drum 234 rotates in a counter-clockwise direction, PCR 232 rotates in a clockwise direction, and the roller cleaner 500 rotates in a counter-clockwise direction. Also visible in FIG. 4 are the wiper blade assembly 236 which functions to remove residual toner from the drum, and the waste hopper 238, which receives the residual toner.

The body 504 of the roller cleaner may be made of any of the known materials suitable for removing contaminants from a PCR roller. In an exemplary embodiment of the invention, the body of the roller is formed of an open cell foam material. In other embodiments the body of the roller cleaner may be a closed cell foam or other resilient material, or a velvet-like tufted fabric having evenly distributed cut threads, with a short dense pile, fastened to the shaft with an adhesive or another resilient material.

As seen in FIG. 4, the PCR roller cleaner 500 may have a different diameter than the PCR 232, which avoids having the same areas of the roller cleaner and PCR repeatedly coming into contact. Thus, any part of the PCR is cleaned by a different part of the roller cleaner on sequential passes, avoiding a localized buildup of contaminants on the roller cleaner. The "nip" width 510 where the roller cleaner contacts the PCR is substantially determined by the force with which the roller cleaner is pressed against the PCR, and is selected such that adequate cleaning of the PCR occurs, without substantially impeding PCR rotation. Excessive force of the roller cleaner 500 against the PCR 232 can result in a variety of print defects, as the drag on the PCR can also result in drag on the photosensitive drum 234. In an exemplary embodiment of the invention the nip width of the contact area is selected to be between about 0.020 inches and 0.030 inches.

Other factors can affect the cleaning efficiency of the roller cleaner and the drag induced on the PCR, such as, for example, the diameter of the holes in the joining links relative to the PCR and roller cleaner shafts. Larger holes may reduce friction, but allow the roller cleaner to wobble. The detailed design of the links is a function of a large number of variables, such as the materials used for the roller cleaner and the links, the nip area needed for good cleaning, the use of lubricants, and the specifics of a particular toner cartridge model. As such, some "trial and error" and extensive testing is required to achieve an optimum design.

Figure 5:
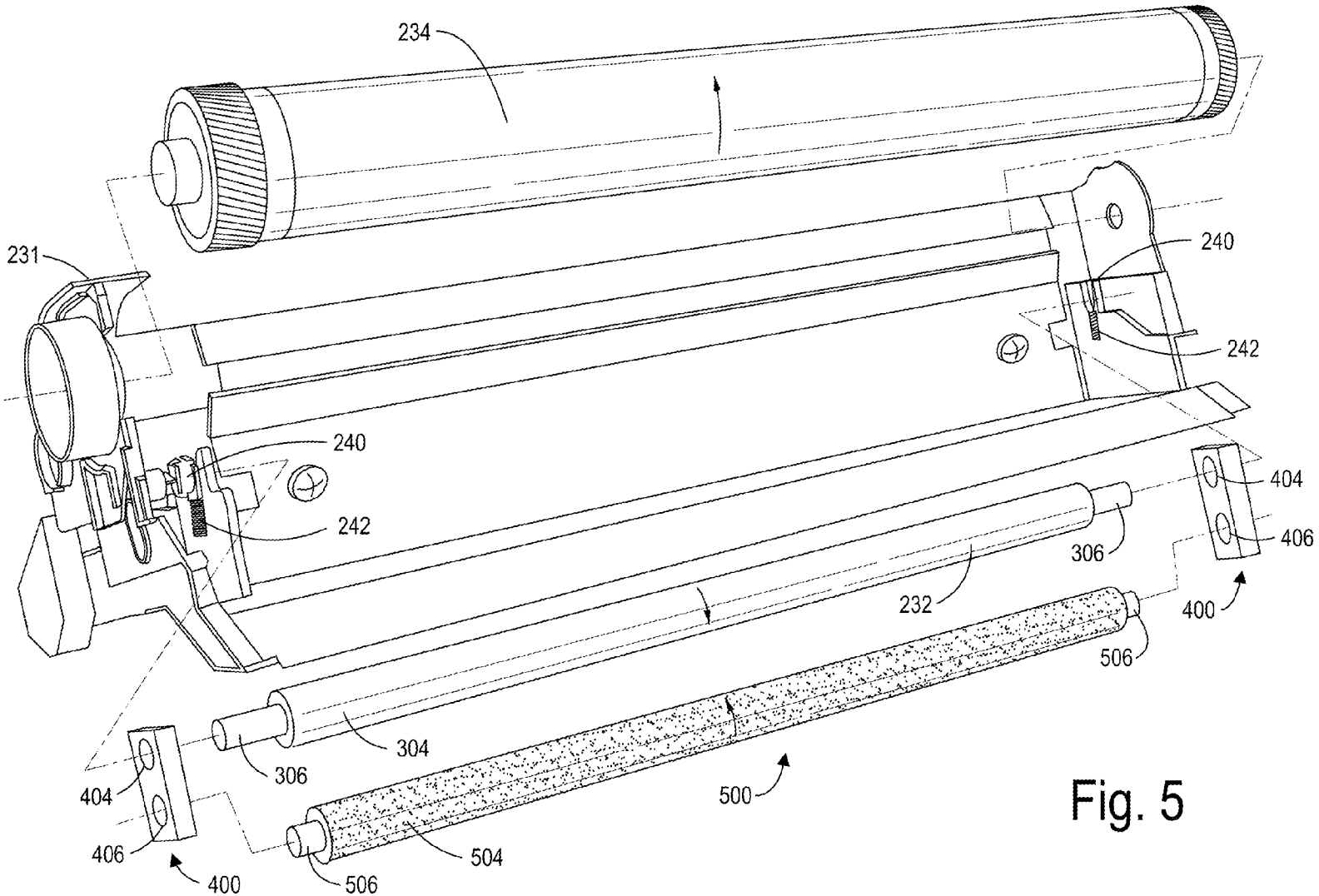
FIG. 5 is an exploded view of the FIG. 3 cartridge.

FIG. 5 is an exploded view of the FIG. 3 cartridge waste toner hopper further illustrating how the roller cleaner 500 is attached to the PCR 232 with joining links 400 and then fitted into the waste toner hopper chassis 231. The joining links 400 are simple mechanical links, each having a first hole 404 to accommodate the PCR shaft endpost 306 and a second hole to accommodate the roller cleaner shaft endpost 506. The joining links are made of a material such as a plastic having adequate strength to hold the cylindrical roller body 504 of the roller cleaner 500 in rotatable contact with the cylindrical body 304 of the PCR 232, and also having a low coefficient of friction with the metal shaft endposts 306, 506, such that the roller cleaner turns freely when the PCR turns. One suitable material for the links polyoxymethylene, an engineering thermoplastic used in machined parts that require high stiffness, low friction and good dimensional stability, and commonly known under the DuPont Company's trade name DELRIN.

A shaft endpost 306 of the PCR 232 extends through the first hole 404 of each joining link 404, with a sufficient length of shaft beyond the link such that the combined PCR 232, joining links 400, and roller cleaner 500 may be reinstalled in the waste toner hopper chassis 231 in the same manner as the original PCR alone. The PCR shaft endposts 306 engage saddles 240 in the waste hopper chassis 231 that retain the shafts in a snap fitting while allowing them to rotate. The saddles 240 themselves are typically loosely retained in the waste hopper chassis 231 and urged in the direction of the photosensitive drum 234 by coil springs 242, as is well known in the art; the force of the coil springs ensuring that the PCR 232 maintains contact with the photosensitive drum 234 and thus rotates when the drum rotates. At least one of the saddles provides the electrical connectivity for the PCR.

Thus, in installing the roller cleaner during remanufacture of a toner cartridge, the PCR 232 would typically be removed from the waste toner hopper saddles and cleaned; the cleaning roller 500 would then be attached to the PCR with the joining links 400, and the PCR then reinstalled into the waste toner hopper saddles. In some embodiments of the invention, the saddles may be treated with additional grease to provide better lubrication, or the holes 404 & 406 of the links may likewise be greased.

Alternative embodiments of the cleaning mechanism are possible. For example, the joining links could be more complex, incorporating, for example, springs (not shown) to urge the cleaning roller against the PCR, or the joining links could engage the PCR or cleaning roller shafts in some other manner, such a snap fit mechanisms (not shown) to further simplify installation. The links may be formed of an alternate material, such as metal. Rather than relying solely on contact between the cleaning roller and the PCR to cause the cleaning roller to rotate, a gearing mechanism (not shown) between the PCR and the cleaning roller (or between some other mechanism in the cartridge and the cleaning roller) could be utilized, or rubber bands or other mechanisms could be employed. In some embodiments, it may also be desirable to attach the roller cleaner to some other internal structure of the cartridge (not shown), rather than to the to the PCR itself. It is the intent of the applicants that the invention include the attachment of a cleaning roller to a PCR in a remanufactured cartridge, regardless of the manner of the attachment, limited only by the claims.

Figure 6:
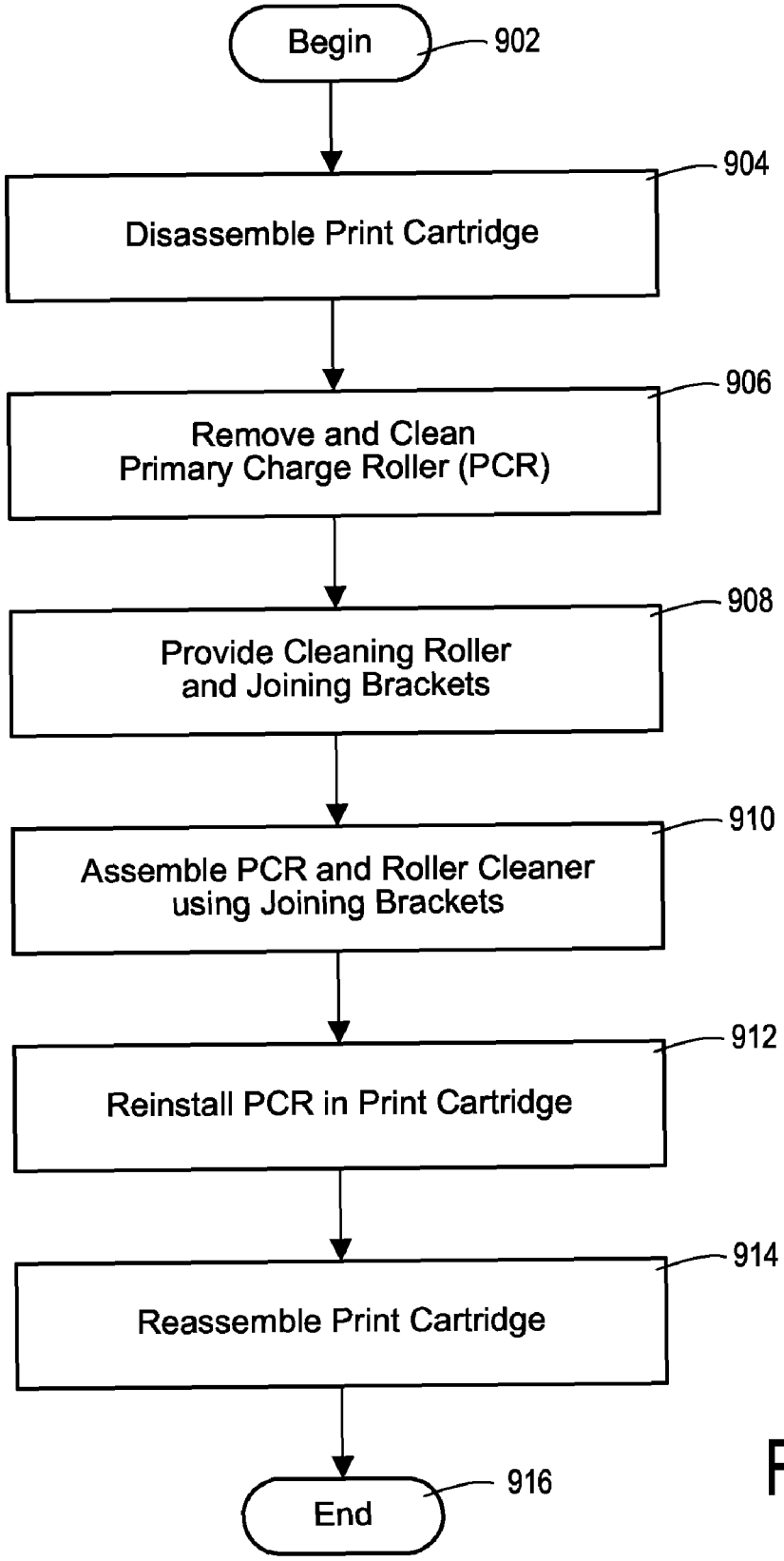
FIG. 6 is a flow diagram illustrating an exemplary method of the invention.

FIG. 6 is a flow chart of an exemplary method of the invention. The method starts 902 with disassembly 904 of a print cartridge, such as, for example, by detaching the waste hopper assembly from the rest of the cartridge to allow access to the Primary Charge Roller (PCR). The PCR is then removed from the cartridge and cleaned 906. Alternatively, rather than cleaning the existing PCR, a replacement PCR may be provided.

A cleaning roller and joining links are provided 908, and are assembled onto the PCR 910. The combined PCR, roller cleaner, and joining links are then reinstalled into the cartridge 912, fitting into the cartridge in the same manner as the original PCR alone. The print cartridge may then be reassembled 914, which may include cleaning or replacing other components and refilling the cartridge with toner, and the method ends 916.

While an exemplary embodiment of the method includes the steps outlined above, other embodiments may follow an alternate sequence of steps or omit steps. For example, a cleaning roller might be "clipped" onto the PCR without removing the PCR from the cartridge (with the joining links having a "snap" fitting at the PCR end, rather than a hole), or a cartridge may be obtained already in a disassembled state, or left disassembled after modification. It is the intent of the applicants that methods of the invention include all methods which result in the addition of a PCR cleaning roller to a remanufactured laser printer toner cartridge, however achieved, as recited in the claims.

Although specific embodiments of the invention have been described, various modifications, alterations, alternative constructions, and equivalents are also encompassed within the scope of the invention. The specification and drawings are, accordingly, to be regarded in an illustrative rather than a restrictive sense. It will, however, be evident that additions, subtractions, deletions, and other modifications and changes may be made thereunto without departing from the broader spirit and scope of the invention as set forth in the claims.

What is claimed is:

1. A method of remanufacturing a laser printer toner cartridge, the toner cartridge having a primary charge roller, the primary charge roller having shaft endposts that engage saddles within the toner cartridge, the method comprising:

disassembling the laser printer toner cartridge to remove the primary charge roller from the saddles within the toner cartridge;

providing a primary charge roller cleaning roller adapted to clean the primary charge roller through rotatable contact with the primary charge roller;

providing joining links adapted to attach the primary charge roller cleaning roller to the shaft endposts of the primary charge roller;

attaching the primary charge roller cleaning roller to the primary charge roller with the joining links;

reinstalling the primary charge roller into the saddles within the toner cartridge; and substantially reassembling the laser printer toner cartridge.

2. The method of remanufacturing a laser printer toner cartridge of claim 1, wherein the primary charge roller cleaning roller has a cylindrical body covered with a cloth material.

3. The method of remanufacturing a laser printer toner cartridge of claim 1, wherein the primary charge roller cleaning roller has shaft endposts, and wherein the joining links each have a first hole adapted to receive the primary charge roller cleaning roller shaft endposts.

4. The method of remanufacturing a laser printer toner cartridge of claim 1, wherein the joining links each have a second hole adapted to receive the primary charge roller shaft endposts.

5. The method of remanufacturing a laser printer toner cartridge of claim 3, wherein the joining brackets are formed of a plastic material.

6. The method of remanufacturing a laser printer toner cartridge of claim 5, wherein the joining brackets are formed of polyoxymethylene.

7. A method of remanufacturing a laser printer toner cartridge, the toner cartridge having a primary charge roller with a cylindrical body, the toner cartridge not having a primary charge roller cleaning roller, the method comprising:

providing a primary charge roller cleaning roller having a body portion adapted to clean the primary charge roller through rotatable contact; and installing the primary charge roller cleaning roller in the laser printer toner cartridge.

8. The method of remanufacturing a laser printer toner cartridge of claim 7, wherein the primary charge roller further has bare shaft portions;

the primary charge roller cleaning roller has bare shaft portions;

and wherein installing the primary charge roller cleaning roller in the laser printer toner cartridge comprises attaching the primary charge roller cleaning roller to the primary charge roller with joining links, the joining links engaging the bare shaft portions of the primary charge roller cleaning roller and the bare shaft portions of the primary charge roller.

9. The method of remanufacturing a laser printer toner cartridge of claim 8, wherein the toner cartridge includes saddles for receiving the bare shaft portions of the primary charge roller, and wherein the joining links engage the primary charge roller bare shaft ports adjacent to the saddles.

10. The method of remanufacturing a laser printer toner cartridge of claim 8, wherein the joining links are formed of a plastic material.

11. The method of remanufacturing a laser printer toner cartridge of claim 10, wherein the joining links are formed of polyoxymethylene.

12. A remanufactured previously used laser printer toner cartridge, the previously used laser printer toner cartridge having a primary charge roller, the primary charge roller having endposts retained in saddles within the toner cartridge, the previously used laser printer toner cartridge lacking a primary charge roller cleaning roller that cleans contaminants from the primary charge roller by rotatable contact, the remanufactured previously used laser printer toner cartridge comprising:

a primary charge roller cleaning roller adapted to clean the primary charge roller through rotatable contact with the primary charge roller, the primary charge roller cleaning roller having shaft endposts; and joining links engaging the primary charge roller cleaning roller endposts and the primary charge roller endposts adjacent to the toner cartridge saddles.

13. The remanufactured previously used laser printer toner cartridge of claim 12, wherein the joining links each comprise a body having a first hole and a second hole, the first hole adapted to receive a primary charge roller endpost and the second hole adapted to receive a primary charge roller cleaning roller endpost.

14. The remanufactured previously used laser printer toner cartridge of claim 12, wherein the joining links are formed of a plastic material.

15. The remanufactured previously used laser printer toner cartridge of claim 14, wherein in joining links are formed of polyoxymethylene.

* * * * *